United States Patent [19]

Zedrosser

[11] Patent Number: 4,817,496

[45] Date of Patent: Apr. 4, 1989

[54] FIREARM

[75] Inventor: Ulrich Zedrosser, Steyr, Austria

[73] Assignee: Steyr-Daimler-Puch AG, Vienna, Austria

[21] Appl. No.: 134,173

[22] Filed: Dec. 17, 1987

[30] Foreign Application Priority Data

Dec. 19, 1986 [AT] Austria ..... 3389/86

[51] Int. Cl.[4] ..... F41D 5/04

[52] U.S. Cl. ..... 89/191.02

[58] Field of Search ..... 89/191.01, 191.02

[56] References Cited

U.S. PATENT DOCUMENTS

| | | | |
|---|---|---|---|
| 663,955 | 12/1900 | Burgess | 89/191.02 |
| 3,261,264 | 7/1966 | Wilson | 89/191.01 |
| 3,273,460 | 9/1966 | Mason | 89/191.02 |
| 3,848,511 | 11/1974 | Zanoni | 89/191.02 |

FOREIGN PATENT DOCUMENTS

| | | |
|---|---|---|
| 319816 | 1/1975 | Austria . |
| 2647899 | 4/1978 | Fed. Rep. of Germany . |
| 228678 | 12/1943 | Switzerland . |

*Primary Examiner*—Deborah L. Kyle
*Assistant Examiner*—Richard Klein
*Attorney, Agent, or Firm*—Marmorek, Guttman & Rubenstein

[57] ABSTRACT

A firearm comprises a gas drive for actuating loading and/or firing means in response to the discharge of a round, wherein the gas drive comprises a pneumatic cylinder and a pneumatic piston, the cylinder chamber communicates with the barrel bore through at least one transverse bore in the barrel, and powder gas is adapted to enter said cylinder chamber through said transverse bore and to move said cylinder and piston relative to each other against the force of a return spring. In order to provide a gas drive which is particularly simple and functionally reliable, light in weight and compact, the barrel is provided with a collar or the like, which constitutes a stationary pneumatic piston, and the pneumatic cylinder consists of a sliding sleeve, which surrounds the collar and is longitudinally displaceable between stops.

7 Claims, 2 Drawing Sheets

FIREARM

BACKGROUND OF THE INVENTION

1. Field of the Invention

This invention relates to a firearm comprising a gas drive for actuating loading and/or firing means in response to the discharge of a round, wherein the gas drive comprises a pneumatic cylinder and a pneumatic piston, the cylinder chamber communicates with the barrel bore through at least one transverse bore in the barrel, and powder gas is adapted to enter said cylinder chamber through said transverse bore and to move said cylinder and piston relative to each other against the force of a return spring.

2. Description of the Prior Art

For a semi-automatic or fully automatic operation of a firearm, drive means must be provided for the performance of individual steps of the loading and ejecting operation or for the entire loading and priming operation. Gas drives in which the residual energy contained in the powder gases when the round has been discharged have proved satisfactory as drive means. The previous gas drives consist of piston-cylinder units which are separate from the barrel and their cylinders have rigidly been connected to the barrel or to the housing and the reciprocating piston is moved to actuate the corresponding members of the loading and/or firing mechanism by means of a piston rod or the like. As such piston-cylinder units consist of a substantial number of expensive components they involve a substantial structural expenditure and occupy a large valuable space and also add to the weight of the firearm.

SUMMARY OF THE INVENTION

It is an object of the invention to eliminate said disadvantages and to provide a firearm which is of the kind described first hereinbefore and which distinguishes in that its gas drive is particularly simple and functionally reliable, light in weight and compact.

That object is accomplished in accordance with the invention in that the barrel is provided with a collar or the like, which constitutes a stationary pneumatic piston, and the pneumatic cylinder consists of a sliding sleeve, which surrounds the collar and is longitudinally displaceable between stops. Because the barrel constitutes an essential component of the gas drive the number of additional parts which are required for the drive is reduced and an effective and yet rugged drive is obtained, which can economically be manufactured, can be accommodated in the firearm without involving space problems, and permits weight to be saved owing to its light-weight structure.

Within the scope of the invention the transverse bore may open in the end face of the collar so that the functional reliability will not be adversely affected if the sleeve in an initial position contacts the collar. As a result, the gas drive has a relatively short overall langth.

If annular grooves are formed in the barrel in the region over which the sleeve is displaceable, a seal which is similar to a labyrinth seal will be provided for the sleeve so that the efficiency of the drive will be improved and the risk of soiling will be reduced.

In a particularly desirable embodiment of the invention that stop for the sleeve which is opposite to the collar is resilient so that the impact of the gas-actuated sleeve on the stop will be weakened and, above all, the reversal and the return movement of the sleeve and of those parts of the loading and/or firing means which are connected to the sleeve can be accelerated.

If the stop consists of a bushing which surrounds the barrel and axially bears on the housing, which receives the barrel, and said bushing is formed with transverse slots in the feely protruding end of the stop, the stop will have a simple structure and will have the desired characteristic of a stiff spring.

DETAILED DESCRIPTION OF THE PREFERRED EMBODIMENT

Figure 1:
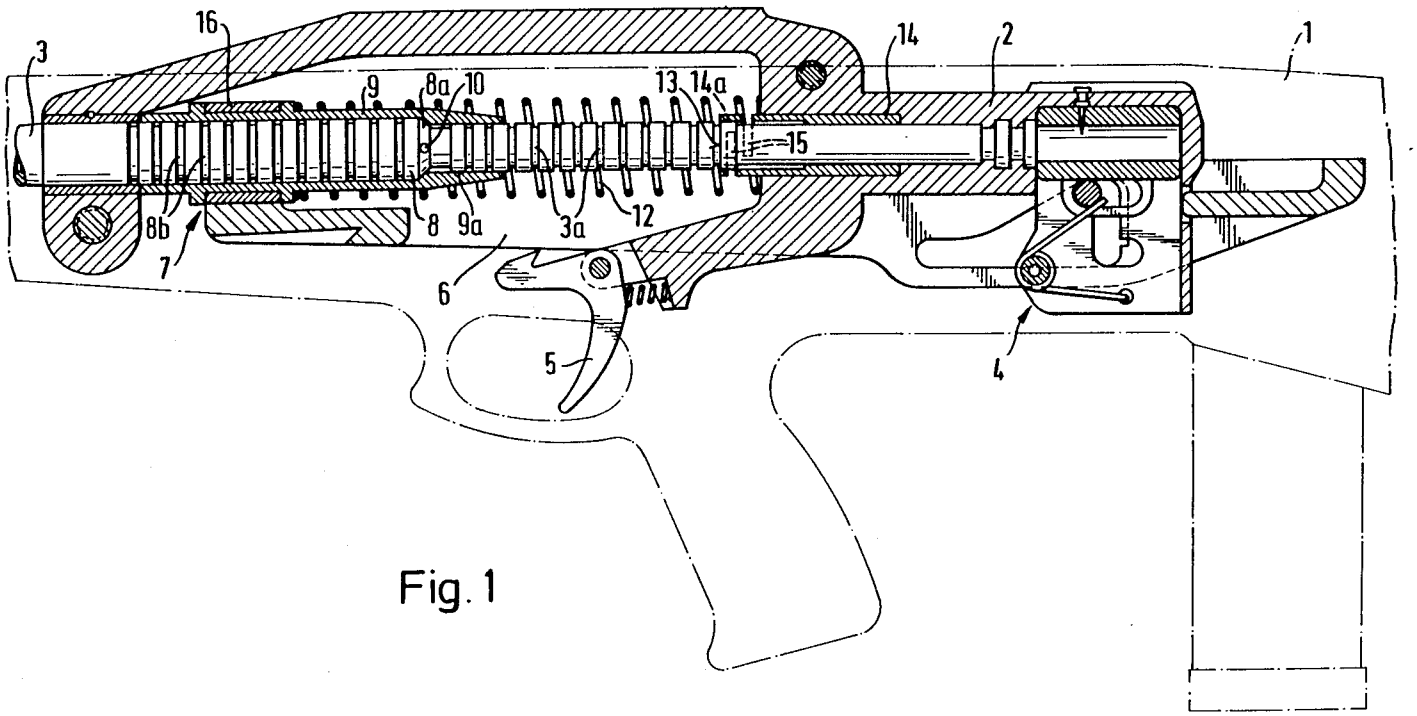
FIG. 1 is a fragmentary longitudinal sectional view showing a part of a firearm according to the invention and FIG. 2 is a similar sectional view showing the firearm with the gas drive in an extended position.

An illustrative embodiment of the invention is shown on the drawing.

A firearm 1, which is only diagrammatically indicated, comprises a housing 2, a barrel 3 and loading and firing means 4 including a trigger 5. For the actuation of said loading and firing means 4, a slider 6 is provided, which is displaceable in the direction of the barrel and is moved by a gas drive 7 in response to the discharge of a round. The gas drive 7 consists of a pneumatic piston, which is constituted by a collar 8 of the barrel 3, and of a sliding sleeve 9, which constitutes the associated pneumatic cylinder and surrounds the collar as a sliding fit and is mounted on the barrel 3 and displaceable along the same. The end face **8*a* of the collar 8 contains an opening of a transverse bore 10, through which the cylinder chamber 11 between the collar 8 and the portion 9*a* of the sliding sleeve 9 communicates with the barrel bore. The sleeve portion 9*a* conforms to and is a sliding fit on the barrel. As a result, powder gases can be supplied to the cylinder chamber 11 when a round has been discharged. To seal the sleeve 9 against the barrel 3 and the collar 8, the barrel 3 and the collar 8 are formed with annular grooves 3*a* and 8*b* in the region over which the sleeve 9** is displaceable.

By the gases supplied to the cylinder chamber 11, the sliding sleeve 9 can be displaced against the force of a return spring 12. The displacement of the sleeve 9 is limited by a limit stop 13. The limit stop 13 consists of a bushing 14, which bears on the housing 2 and which has a freely protruding stop end **14*a* that is formed with transverse slots 15 so that a resilient stop for the sliding sleeve 9 is provided. The collar 8 is formed with an annular rib, which limits the movement imparted to the sliding sleeve 9 by the return spring 12. The annular grooves 3*a* are formed on the outside surface of the barrel 3 between the collar 8 and the stop 13**.

Figure 2:
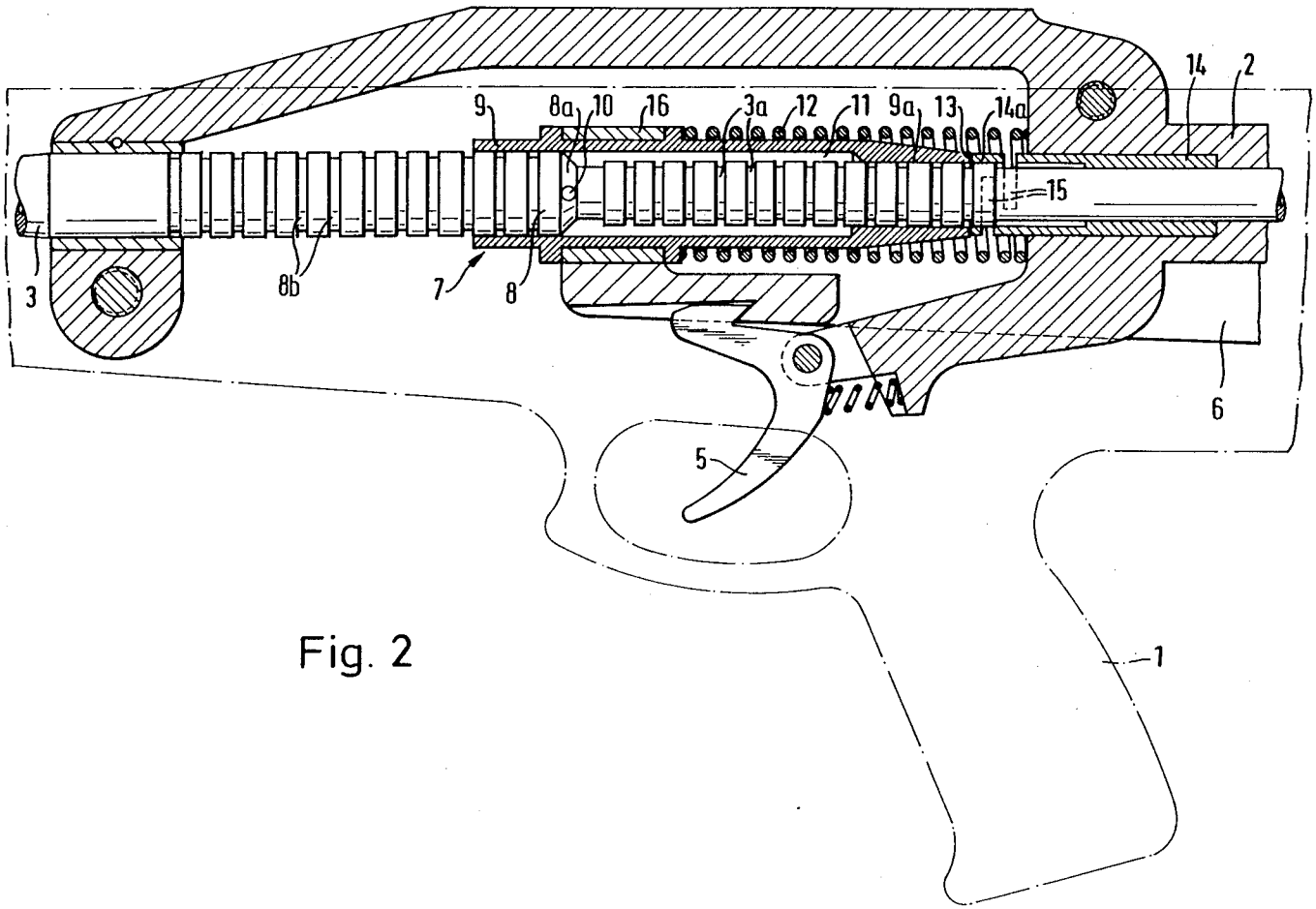

In order to actuate the loading and firing means 4 by the gas drive 7, the slider 6 engages a coupling ring 16, which is connected to the sliding sleeve 9 so that the displacement of the sliding sleeve 9 will directly be transmitted to the slider 6 for the actuation of the loading and firing means 4. After the discharge of each round, powder gases flow through the transverse bore into the cylinder chamber 11 and urge the sliding sleeve 9 against the limit stop 13. When the trigger 5 has been pulled as far as possible, the return spring 12 will immediately throw back the sliding sleeve 9 and the buffer spring which results from the presence of the transverse slots 15 in the stop end **14*a* will weaken the impact of the sliding sleeve 9 against the limit stop 13 and will accelerate the reversal of the movement. When the trigger 5 is released after the discharge of the round, the trigger in the illustrated embodiment will intercept the slider 6 in its extended position, shown in FIG. 2, so that the motion will be interrupted. As a result, the firearm can be used for single fire as well as for sustained fire when the trigger 5** is continuously pulled.

I claim:

1. A firearm comprising a housing, a barrel disposed in said housing, said barrel including a barrel bore, a main body portion having a first outer diameter, and a collar having a second outer diameter, said second outer diameter larger than said first outer diameter, said collar being integral with said barrel, a stop fixed to said barrel, said collar being axially spaced at a fixed distance from said stop, an actuating mechanism, a gas drive comprising stationary pneumatic piston means comprising said collar and said main body portion of said barrel, and a movable pneumatic cylinder for receiving said piston means, said pneumatic cylinder comprising a sliding sleeve which is displaceable along said barrel and along said collar into engagement with said stop, said sleeve including a first portion dimensioned to be in sliding engagement with said main body portion of said barrel and a second portion dimensioned to be in sliding engagement with said collar, said sleeve and said barrel defining a cylinder chamber between said collar and said first portion of said sleeve, said barrel including a transverse bore connecting said barrel bore with said cylinder chamber to permit powder gases formed in said barrel bore by the discharge of each round to enter said cylinder chamber and to displace said sleeve along said barrel against said stop, said collar including annular grooves on its outside surface which comes into sliding engagement with said sleeve, said barrel also including annular grooves on its outside surface in sliding engagement with said sleeve between said collar and said stop, means for operatively connecting said sleeve with said actuating mechanism, and a return spring for urging said sleeve away from said stop.

2. The firearm set forth in claim 1 wherein said actuating mechanism comprises a loading mechanism.

3. The firearm set forth in claim 1 wherein said actuating mechanism comprises a firing mechanism.

4. The firearm set forth in claim 1 wherein said actuating mechanism comprises a loading and firing mechanism.

5. The firearm set forth in claim 1 wherein said stop has a resilient end portion facing said sliding sleeve.

6. A firearm comprising a housing, a barrel disposed in said housing, said barrel including a barrel bore, a main body portion having a first outer diameter, and a collar having a second outer diameter, said second outer diameter being larger than said first outer diameter, a stop fixed to said barrel, said collar being axially spaced at a fixed distance from said stop, an actuating mechanism, a gas drive comprising pneumatic piston means comprising said collar and said main body portion of said barrel, and a pneumatic cylinder for receiving said piston means, said pneumatic cylinder comprising a sliding sleeve which is displaceable along said barrel relative to said collar and into engagement with said stop, said sleeve including a first portion dimensioned to be in sliding engagement with said main body portion of said barrel and a second portion dimensioned to be in sliding engagement with said collar, said sleeve and said barrel defining a cylinder chamber between said collar and said first portion of said sleeve, said barrel including a transverse bore connecting said barrel bore with said cylinder chamber to permit powder gases formed in said barrel bore by the discharge of each round to enter said cylinder chamber and to displace said sleeve along said barrel against said stop, said collar including annular grooves on its outside surface in sliding engagement with said sleeve, said barrel also including annular grooves on its outside surface in sliding engagement with said sleeve between said collar and said stop, means for operatively connecting said sleeve with said actuating mechanism, a return spring for urging said sleeve away from said stop, said barrel extending into said housing, said stop comprising a bushing which surrounds and is fixed to said barrel and axially bears against said housing, said stop including a free end portion which protrudes from said housing and faces said sliding sleeve, said free end portion including transverse slots.

7. The firearm set forth in claim 6 wherein said free end portion comprises a resilient end portion facing said sliding sleeve.

* * * * *